United States Patent [19]

Lussiez

[11] 4,012,484

[45] Mar. 15, 1977

[54] CHROMITE RECOVERY FROM CHROMITE-BEARING ORE

[75] Inventor: Guy W. Lussiez, Broomfield, Colo.

[73] Assignee: Amax Inc., New York, N.Y.

[22] Filed: Sept. 23, 1974

[21] Appl. No.: 508,423

[52] U.S. Cl. ..... 423/53; 423/150

[51] Int. Cl.[2] ..... C01G 37/14; C01G 51/10; C01G 53/10

[58] Field of Search ..... 423/55, 53, 138, 150; 75/119, 101 R, 115, 121

[56] References Cited

UNITED STATES PATENTS

| | | | |
|---|---|---|---|
| 3,082,080 | 3/1963 | Simons | 423/55 X |
| 3,466,144 | 9/1969 | Kay | 423/150 |
| 3,804,613 | 4/1974 | Zundel | 423/150 |

FOREIGN PATENTS OR APPLICATIONS

| | | | |
|---|---|---|---|
| 229,570 | 7/1960 | Australia | 75/119 |
| 996,472 | 6/1965 | United Kingdom | 75/119 |

OTHER PUBLICATIONS

*Zhur. Prikl. Khim.* 11 (1938) pp. 1564–1574, Losev et al.

Chemical Abstracts vol. 62, 1965, No. 14,222h.

Chemical Abstracts vol. 33, 1939 No. 6003[4].

*Chromium* (Udy, author), vol. II, Reinhold Pub. Corp. 1965 pp. 30, 31.

*Primary Examiner*—O. R. Vertiz

*Assistant Examiner*—Brian E. Hearn

*Attorney, Agent, or Firm*—Kasper T. Serijan; Eugene J. Kalil

[57] ABSTRACT

A method is provided for separating chromium from lateritic ore. The ore which generally also contains nickel and cobalt along with other metal values is leached with a strong sulfuric acid solution of about 10 to 30 normal concentration at an acid to ore ratio of at least 3:1 by weight. The leaching is carried out at a temperature of at least 100° C ranging as high as about 300° C at above atmospheric pressure. An oxidant, such as manganese dioxide, is preferably added to oxidize the chromium to the hexavalent state, the manganese dioxide, or its equivalent, being advantageous in improving the chromium yield at the lower end of the leaching temperature range.

13 Claims, 2 Drawing Figures

CHROMITE RECOVERY FROM CHROMITE-BEARING ORE

This invention relates to the recovery of chromium from lateritic ores, such as the ores containing nickel and cobalt.

STATE OF THE ART

Generally speaking, chromium is recovered from high grade ores containing by weight 30% to 60% chromium as chromium oxide together with 12% to 25% iron in the form of ferrous oxide. However, the recovery of chromium from low grade ores has not been economically feasible.

A method which has been proposed for recovering chromium from nickel lateritic ores which generally contain less than 5% chromium is disclosed in U.S. Pat. No. 3,082,080 (Mar. 19, 1963). In that method, the ore is mixed with tetravalent manganic oxide mineral in an amount sufficient stoichiometrically to oxidize the chromium, the ore being leached in an aqueous acid solution containing sulfuric acid corresponding to at least 40% to the dry weight of the ore, the amount of acid in the slurry being predetermined so as not to dissolve any substantial proportion of the iron present. A temperature of at least about 475° F is used at superatmospheric pressure.

A disadvantage of the foregoing method is that the chromium yield is not sufficiently high. According to recent work, it appears that chromium is present in two forms, a soluble form and an insoluble form, the soluble form being soluble in relatively dilute sulfuric acid.

RELATED CASE

In copending application Ser. No. 508,419 filed Sept. 23, 1974, it is stated that soluble chromium generally appears in the fines fraction of lateritic ores. Thus, the application points out that by sizing lateritic ore to provide a size fraction of fines in which substantially all of the chromium therein is acid-soluble, the chromium can be leached out very easily, the coarse fraction generally containing the more insoluble chromium.

It would be desirable to provide a method of leaching chromium-containing nickel and cobalt lateritic ore independent of the form of the chromium.

OBJECTS OF THE INVENTION

It is thus the object of the invention to provide a method of leaching chromium-containing lateritic ore in which substantially all of the chromium is removed therefrom.

Another object is to provide a method of leaching chromium from nickel-cobalt lateritic ores wherein high recoveries of nickel and cobalt are obtained with the chromium.

It is a further object of the invention to provide a method of recovering chromium from lateritic ore wherein a coarse fraction thereof is leached with a very strong sulfuric acid solution to form a pregnant solution thereof and wherein a remaining fines fraction thereof is leached with said pregnant solution after it has been diluted.

These and other objects will more clearly appear when taken in conjunction with the following disclosure, the appended claims and the accompanying drawing, wherein:

STATEMENT OF THE INVENTION

Figure 1:
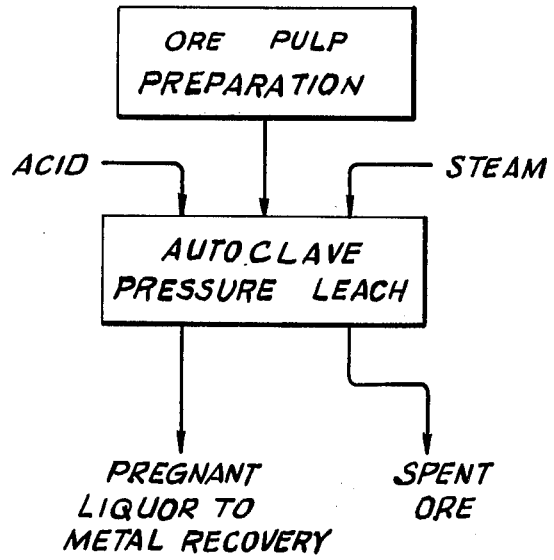
FIG. 1 is a flow sheet as applied to straightforward leaching of the ore.

One embodiment of the invention resides in a method of recovering chromium from lateritic ores comprising the steps of forming an aqueous slurry of said ore with an acid solution containing 10 to 30 normal sulfuric acid, the amount of acid relative to the dry weight of ore being in the ratio of at least 3:1. Following formation of the slurry, it is subjected to leaching at a temperature of at least about 100° C and a pressure of at least about 75 psig depending upon the leaching temperature.

Preferably, the acid to ore ratio may range from about 5:1 to 25:1 by weight, the acid concentration ranging preferably from about 15 to 25 normal (e.g. 17 to 20 N). The temperature generally ranges from about 150° C to 250° C or 300° C at pressures ranging from about 70 psig to 1200 psig.

The invention is particularly applicable to ore in the size range of over 20 microns and ranging up to about 3 mesh (U.S. Standard Screen).

The leaching is effected in an autoclave. In a preferred embodiment, tetravalent manganese, e.g., manganese dioxide, is employed as an oxidizing agent to increase leaching efficiency. Other oxidizing agents may include $MnO_4^{-1}$ or $S_2O_8^{-2}$. The ratio of $MnO_2$ equivalent to the chromium in the ore is generally at least about 1 or 2 by weight and may range up to a ratio of about 4:1.

If no oxidizing agent is used corresponding to $MnO_2$ equivalent, the chromium recovery is a function of temperature, high recoveries being obtained at 250° C and above, e.g. 300° C.

If $MnO_2$ or $MnO_4^{-1}$ or $S_2O_8^{-2}$ is used as the oxidizing agent, the optimum temperature range is about 150° C to 250° C. Particularly high recoveries of chromium have been obtained at 150° C to 200° C at a ratio of $MnO_2$ to chromium of 1 or 2 to 1.

The leaching time may range from about 15 minutes to 2 hours, a leaching time of one-half hour to 1 hour being generally employed when $MnO_2$ or its equivalent is used as an oxidizing agent.

As stated hereinabove, the invention is particularly applicable to coarse fractions of lateritic ores which contain chromium in the insoluble form not readily amenable to leaching using conventional solution compositions. Generally speaking, 50% or more of the total chromium is distributed in the plus 20 micron size fraction of the ore.

Thus, a preferred embodiment which may be used in carrying out the invention comprises sizing the ore into two parts to form a fines fraction which contains soluble chromium and a coarse fraction which contains the remainder of the chromium largely in the insoluble form. The coarse fraction is first high pressure leached using a relatively high concentration of sulfuric acid ranging from about 10 to 30 normal at an acid to ore ratio on the dry basis of at least 3 to 1. The pregnant liquor when introduced into the autoclave and mixed with the fines fraction slurry is diluted to a normality of about 2 to 3 and ranging up to about 10, the fines fraction being leached at an acid to ore ratio ranging from about 0.1 to 0.5. When the pregnant liquor is diluted as above, the ferric sulfate in the solution hydrolyzes from solution to form hematite which is recoverable with the iron in the residue as a relatively high grade iron ore.

In the case where iron sulfate goes to the residue, the washed and dried residue can be roasted to remove the sulfur as sulfur dioxide which can be used to form sulfuric acid.

The process is applicable to any low grade chromium-containing ore containing up to about 15% by weight of chromium.

The total chromium content in the ore and in the respective size fractions can be determined in the usual manner by $Na_2O_2$ fusion and the percent soluble chromium in the fraction determined relative to the total chromium content.

DETAILS OF THE INVENTION

Figure 2:
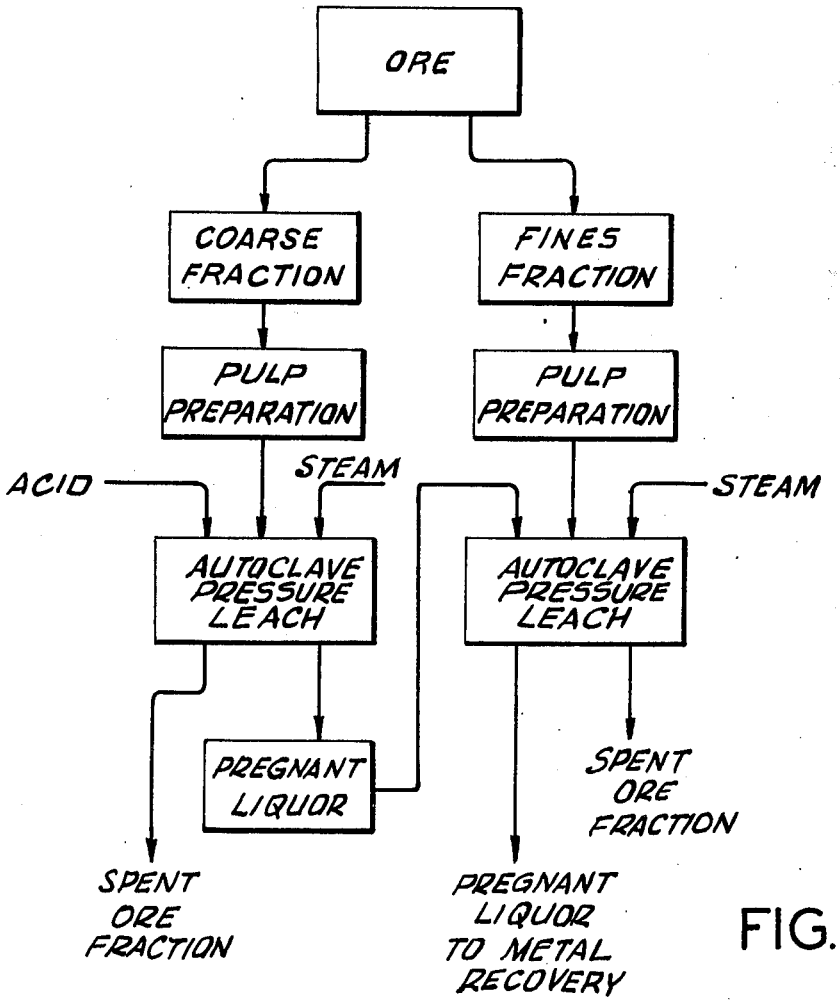
FIG. 2 is a flow sheet coordinating the leaching of a coarse fraction with the leaching of a fines fraction, wherein the pregnant liquor of the coarse fraction is recycled to the fines fraction.

As has been stated herein, the invention can be applied to the whole ore (note FIG. 1) or to a coarse size fraction thereof (note FIG. 2).

One example of the treatment of a coarse fraction is given below.

A 100 – 200 mesh (U.S. Standard Screen) fraction of a lateritic ore containing 1.5% Ni, 0.42% Co, 6.2% Cr, 3.4% Al, 24.0% Fe, 1.8% Mn, 30.7% $SiO_2$, and 3.1% Mg combined with oxygen was pressure leached in an autoclave at 150° C for one hour at a pressure of about 70 psig. The pulp density of the slurry formed with the sulfuric acid solution was about 3% the normality of the sulfuric acid solution being about 20 N and the acid to ore ratio on the dry basis being about 20:1. A $MnO_2$ ore concentrate was also added to the slurry prior to the leaching thereof, the ratio of $MnO_2$ to chromium in the ore being about 1:1. After one hour of pressure leaching, analysis of the pregnant liquor indicated that high extraction yields were obtained. The extraction yield for nickel, cobalt and manganese was 99%, for chromium 99% and for iron, 98%.

The iron in the ferric state can thereafter be removed from the solution by diluting the solution to a pH conducive to cause the ferric sulfate to hydrolyze as a ferric hydroxide precipitate. The hydrolysis of the ferric sulfate will, however, be accompanied by the liberation of a correspondingly large amount of sulfuric acid. This acid must either be neutralized or diluted to permit the continuous production of ferric hydroxide. It would therefore be desirable to introduce the pregnant solution into the autoclave when the fines fraction of the laterite is being processed and, in this way, the sulfuric acid would be neutralized by the acid-consuming constituents in the ore.

In the situation where $MnO_2$ is not used to oxidize the chromium, a higher temperature of about 250° C was found necessary to effect an extraction efficiency for chromium of about 84% using an acid concentration of about 20 N and an acid to ore ratio of about 20:1.

Tests have indicated that the acid to ore ratio has an effect on the chromium extraction, while not substantially affecting the nickel and cobalt extraction.

The nickel and cobalt recovery is fairly high and constant at an acid to ore ratio of 5:1 to 20:1. On the other hand, the chromium extraction drops to 84% at an acid to ore ratio of 5:1 and to as low as 63% at a ratio of 3:1.

Leaching time has an important effect on the chromium extraction. For example, at an acid to ore ratio of 20:1 and an acid normality of 20 and a temperature of 250° C (no $MnO_2$), the chromium extraction reaches 97% in 3 hours as compared to 84% in one hour.

However, when $MnO_2$ ore concentrate is added to the slurry in an amount corresponding to 12% of the coarse fraction weight of the ore, a chromium extraction efficiency of 99% is obtained in one hour at a temperature of about 150° C to 200° C and a pressure of 70 – 220 psig.

As illustrative of additional embodiments of the invention, the following examples are given:

EXAMPLE 1

A low grade chromium-containing lateritic ore of 100 to 200 mesh size fraction having the following composition was treated in accordance with the invention:

| | | | |
|---|---|---|---|
| % Ni | 1.5 | % Fe | 24.0 |
| % Co | 0.4 | % Mg | 3.1 |
| % Cr | 6.2 | % $SiO_2$ | 30.7 |
| % Mn | 1.8 | % S | 0.1 |
| % Al | 3.4 | | |

The foregoing elemental metals are combined with oxygen.

The ore fraction was treated for one hour at various temperatures ranging from 20° C to 300° C without the addition of $MnO_2$ and at pressures ranging from about 0.2 psig to 1200 psig. The flow sheet for this leaching process is disclosed in FIG. 1.

The test results indicated that low extraction efficiencies were obtained at temperatures below 100° C and that optimum results were obtained at temperatures over 100° C, especially at 150° C and up to 250° C or 300° C.

The tests also indicated that for consistent results, the normality of the leach solution should be in excess of 3, and preferably in excess of 5, optimum results being obtained at acid concentrations of 10N to 30N, e.g. 20N.

Temperature is particularly important in the extraction of chromium, chromium being much more sensitive to leaching temperature than nickel and cobalt.

The extraction efficiencies obtained as a function of temperature with an acid to ore ratio of 20:1 and an acid concentration of 20N are given for Ni, Co, Cr, Mn, Mg and Al in Table 1. (Leaching time was 1 hour).

Table 1

| Solution Temp ° C | % Extraction of Metal Values | | | | | |
|---|---|---|---|---|---|---|
| | % Ni | % Co | % Cr | % Mn | % Mg | % Al |
| 20 | 4 | 2.5 | — | 2.5 | 4 | — |
| 50 | 30 | 8 | 2 | 10 | 14 | 15 |
| 100 | 97 | 97 | 14 | 97 | 40 | 60 |
| 150 | 97 | 97 | 30 | 97 | 49 | 72 |
| 200 | 98 | 98 | 47 | 98 | 50 | 78 |
| 250 | 98 | 98 | 64 | 98 | 61 | 84 |
| 300 | 98 | 98 | 82 | 98 | 78 | 90 |

As will be noted from Table 1, in order to effect substantial solution of chromium, a temperature in excess of 100° C, and preferably in excess of 125° C, should be used, e.g. about 250° C to 300° C.

EXAMPLE 2

The same ore fraction (100/200 mesh) was leached using varying amounts of $MnO_2$ as an oxidant, the amount of $MnO_2$ varying from 0 to 30% by weight of said coarse ore fraction. The acid to ore ratio was 20:1 at an acid concentration of 20N, the leaching temperatures employed being 150° C, 200° C and 250° C, respectively. The following results were obtained:

Table 2

| % $MnO_2$ | Temp. ° C | % Cr Extracted |
|---|---|---|
| 0 | 150 | 25 |
| 0 | 200 | 49 |
| 0 | 250 | 83 |
| 5 | 150 | 88 |
| 5 | 200 | 97 |
| 5 | 250 | 98 |
| 10 | 150 | 99 |
| 10 | 200 | 99 |
| 10 | 250 | 98 |
| 15 | 150 | 99 |
| 15 | 200 | 99 |
| 15 | 250 | 99 |
| 20 | 150 | 99 |
| 20 | 200 | 99 |
| 20 | 250 | 99 |
| 25 | 150 | 99 |
| 25 | 200 | 99 |
| 25 | 250 | 99 |
| 30 | 150 | 99 |
| 30 | 200 | 99 |
| 30 | 250 | 99 |

The foregoing data confirm that if no oxidant ($MnO_2$) is used, a leaching temperature of 250° C or above is necessary to achieve extraction of major amounts of chromium from the coarse fraction of the ore.

However, the mere addition of $MnO_2$ greatly enhances the dissolution of chromium at the lower end of the temperature range. Thus, when 5% by weight of $MnO_2$ is added to the ore fraction, 88% of the chromium is extracted at 150° C as compared to only 25% extraction when no $MnO_2$ is added. As will be noted from the table, when the amount of added $MnO_2$ reaches 10% by weight of the ore weight, the percent extraction at 150° C is very high, that is to say, 99%. The addition of 15%, 20%, 25% and 30% respectively of $MnO_2$ adds nothing further to the extraction efficiency of chromium. Thus, with $MnO_2$, the leaching is efficient at the lower temperature range of 150° C to 250° C.

Generally speaking, the weight ratio of $MnO_2$ to chromium content of the ore being treated is at least 1:1 and may range up to about 4:1.

EXAMPLE 2

In order to assure consistent recovery of chromium, it is important that the acid to ore ratio be at least 3:1, preferably at least about 5:1 and range upwards of 20:1.

This will be apparent from Table 3 which shows the results of leaching a 48/100 mesh fraction of the ore containing 1.4% Ni, 0.48% Co, 7.2% Cr, 2.1% Mn, 3.8% Al, 20.0% Fe, 3.5% Mg and 26.5% $SiO_2$, the elemental metals being combined with oxygen.

The acid concentration was 20N, the leaching being carried out at 250° C without $MnO_2$ for 1 hour. Only the extraction of Ni, Co and Cr was determined.

Table 3

| Acid to Ore Ratio | % Extraction of Metal Values | | |
|---|---|---|---|
| | % Ni | % Co | % Cr |
| 3 | 96 | 94 | 62.5 |
| 5 | 98 | 98 | 83 |
| 10 | 99 | 99 | 84 |
| 15 | 99 | 99 | 84 |

Table 3-continued

| Acid to Ore Ratio | % Extraction of Metal Values | | |
|---|---|---|---|
| | % Ni | % Co | % Cr |
| 20 | 99 | 99 | 84 |

As will be observed from Table 3, when the acid to ore ratio is at least 5:1, the chromium extraction is markedly improved over the results obtained at an acid to ore ratio of 3:1.

EXAMPLE 3

The purpose of this example is to illustrate the embodiment in which the ore is classified to provide a fines fraction of particle size less than 20 microns and a coarse fraction of over 20 microns to 3 mesh.

The compositions of the fractions with respect to the three elements of interest are as follows:

Fines fraction: 1.78% Ni, 0.1% Co, 0.9% Cr.

Coarse fraction: 1.3% Ni, 0.23% Co, 3.5% Cr.

The coarse fraction is first leached by forming a slurry having a pulp density of about 20%, the ore fraction having mixed with it on the dry basis about 10% by weight of $MnO_2$, the acid concentration being about 20N and the acid to ore ratio about 3:1. The coarse fraction is leached at a pressure of about 220 psig and a temperature of 200° C for one hour to dissolve over 95% of the contained nickel, cobalt and chromium.

The pregnant solution is then separated from the residue and mixed with the pulp of the fines fraction of the ore in which the chromium is substantially in the soluble form, the acid concentration of the pregnant liquor being diluted to not over about 3N as a result of the mixing. $MnO_2$ is added to the fines fraction in an amount corresponding to 1 part by weight of $MnO_2$ to 1 part by weight of chromium. A pulp is produced having a density of about 33%, the acid to ore ratio being about 0.25 to 1.

The slurry is leached at a temperature of 250° C and a pressure of 570 psig for about 1 hour. Substantially all of the soluble chromium is extracted with the recycled pregnant liquor together with over 95% of the nickel and cobalt.

In leaching the fines fraction, the slurry generally has a pulp density of over 20% and the pressure and temperature employed may range from about 400 to 1000 psig and 230° C to 280° C, respectively. Coordination of the leaching of the coarse fraction with that of the fines fraction is shown in FIG. 2.

Following extraction of the various metal values of interest from the ore, they are separated from each other by methods well known in the art.

The chromium in the ore is generally in the trivalent form and tends to hydrolyze in relatively dilute solutions when the emf values of the solution are reducing. However, hydrolysis of $Cr^{+3}$ can be prevented at all pH values if the solution emf values are sufficiently oxidizing, for example, by adding tetravalent manganese ion (e.g. $MnO_2$) or its equivalent, such as $MnO_4^{-1}$ or $S_2O_8^{-2}$. It takes 3 moles of $Mn^{+4}$ to oxidize 2 mols of $Cr^{+3}$ to 2 mols of $Cr^{+6}$. Thus, the $MnO_2$ addition (or its equivalent) should be at least stoichiometrically sufficient to oxidize the chromium to hexavalent chromium. The ratio by weight of $Mn^{+4}$ to $Cr^{+3}$ may range from about 1.5:1 to 3:1. The stable chromium ion produced is $Cr_2O_7^{-2}$ which is stable over a broad pH range.

Thus, by leaching the feed material of substantially all of the chromium and by using oxidizing conditions to convert the chromium from the trivalent state to the hexavalent state, the leach residue will be practically free of chromium. However, the chromium may be kept in the trivalent form where it is to be removed by precipitation following the chromium leaching step.

The foregoing method is applicable to nickel lateritic ores containing: about 0.5% to 2.5% nickel; about 0.05% to 1.0% cobalt; about 0.25% to 5.0% manganese; about 0.3% to 15% chromium; about 0.2% to 10% aluminum; about 0.1% to 15% magnesium; about 2% to 45% silica ($SiO_2$); and about 10% to 55% iron. The metal values are present as oxides.

In removing the chromium by pressure leaching as described herein using an aqueous sulfuric acid solution, generally at least 95% of the nickel and cobalt is removed with the chromium together with amounts of manganese, aluminum, magnesium, etc.

As stated above, the metal values can be separated by methods well known in the art. (Note U.S. Pat. No. 3,082,080 and Canadian Pat. No. 678,326). For example, the pregnant liquor can be adjusted to a pH of about 2.5 to 2.8 and the nickel and cobalt removed by precipitation with $H_2S$ in an autoclave at about 122° C and a pressure of about 150 psig. The sulfide precipitate is separated from the effluent chromium-containing solution for further treatment.

The effluent solution may then be adjusted to a pH of about 5.3 to precipitate chromium, for example, trivalent chromium, aluminum and any residual iron in solution. The chromium can be recovered from the precipitate by any known method, such as by aluminothermic smelting.

Any foreign ions remaining in solution following the foregoing precipitation, such as lead, copper, zinc, etc., can be separated by other precipitation techniques. One method is to lower the pH of the solution to about 1.5 and then precipitate these metals as sulfides using $H_2S$.

Where the chromium is recovered in the hexavalent state ($Cr_2O_7^{-2}$), it may be desirable to recover it selectively as a dichromate salt. One method for doing this comprises passing the solution containing the chromium in the hexavalent state (to strip out such cations as $Cr^{+3}$ and $Ni^{+2}$) through cationic exchangers containing an ion exchange resin in which the active member is a strongly acidic sulfonic acid type. Examples of such resins are Dowex-50 which is a strongly acidic nuclea sulfonic acid type in a resin matrix of divinylbenzene; Amberlite −200 which is defined as being strongly acidic sulfonated macroreticular, the resin being styrene divinylbenzene; and Amberlite IR-120 which is a strongly acid sulfonic acid type cationic exchanger, with the resin a polystyrene base. The effluent from this ion exchange system is then neutralized to pH 8, where the oxidizing potential of the solution is so low that little oxidation of an anion resin can occur. The neutralized solution is then treated with an anion exchange resin. When the anion resin is saturated with chromium, it is eluted with sodium hydroxide solution to produce a three percent solution of sodium chromate.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method of extracting chromium from nickel and cobalt-containing lateritic ore while extracting said nickel and cobalt which comprises, mixing with said comminuted ore an amount of an oxidizing agent selected from the group consisting of $Mn^{+4}$, $MnO_4^{-1}$ and $S_2O_8^{-2}$ at least stoichiometrically sufficient to oxidize chromium substantially to the hexavalent state, forming an aqueous slurry of said ore mixture with an acid solution containing 10 to 30 normal sulfuric acid with an acid to ore ratio by weight of about 5:1 to 25:1, and then subjecting said slurry to leaching at a temperature of about 150° C to 300° C and a pressure of about 70 psig to 1200 psig and thereby leach said chromium therefrom.

2. The method of claim 1, wherein the concentration of the sulfuric acid leaching solution is about 15 to 25 normal, and wherein the oxidizing agent is $MnO_2$ added in an amount to the ore determined as the ratio to the amount of chromium present ranges from about 1:1 to about 4:1.

3. A method of extracting chromium from nickel and cobalt-containing lateritic ore having a size fraction of over 20 microns and ranging up to about 3 mesh while extracting said nickel and cobalt which comprises, mixing with said ore an amount of an oxidizing agent selected from the group consisting of $Mn^{+4}$, $MnO_4^{-1}$ and $S_2O_8^{-2}$ at least stoichiometrically sufficient to oxidize chromium substantially to the hexavalent state, forming an aqueous slurry of said ore mixture with an acid solution containing 10 to 30 normal sulfuric acid with an acid to ore ratio by weight of about 5:1 to 25:1, and then subjecting said slurry to leaching at a temperature of about 150° C to 300° C and a pressure of about 70 psig to 1200 psig and thereby leach said chromium therefrom.

4. The method of claim 3, wherein the concentration of the sulfuric acid leaching solution is about 15 to 25 normal, wherein the oxidizing agent is $MnO_2$ added in an amount to the ore determined as a ratio to the amount of chromium present ranges from about 1:1 to about 4:1.

5. A method of extracting chromium from nickel and cobalt-containing lateritic ore while extracting said nickel and cobalt which comprises, sizing said ore to provide a size fraction of fines below 20 microns in which substantial amounts of the chromium is acid-soluble in dilute sulfuric acid solution and also provide a coarse fraction falling within the range of over 20 microns and ranging up to about 3 mesh in which a substantial amount of chromium is insoluble in said dilute sulfuric acid, forming an aqueous slurry of said coarse fraction with an acid solution containing 10 to 30 normal sulfuric acid and having an acid to ore ratio by weight of at least 3:1, subjecting said slurry to leaching at a temperature of about 150° C to 300° C at a pressure of about 70 psig to 1200 psig to leach said chromium therefrom, and form a pregnant solution containing said chromium and an insoluble residue, separating said pregnant solution from said insoluble residue, forming an aqueous pulp of said fines fraction, mixing said pregnant solution with said fines fraction pulp to dilute the acid content thereof to not more than 10N and provide an acid to ore ratio in said fines fraction of about 0.1 to 0.5 by weight, and then subjecting said pulp of fines fraction to pressure leaching at an elevated pressure and temperature to extract said soluble chromium from said fines fraction, thereby producing a final pregnant solution containing substantially said chromium extracted from both the fines fraction and said coarse fraction.

6. The method of claim 5, wherein the acid to ore ratio in the coarse fraction ranges from about 5:1 to 25:1, and wherein the concentration of the sulfuric acid solution in the coarse fraction ranges from about 15 to 25 normal.

7. The method of claim 6, wherein the fines fraction is leached at a temperature of about 230° C to 280° C and a pressure of about 400 to 1000 psig.

8. The method of claim 6, wherein the coarse fraction is leached at a temperature of about 250° C to 300° C.

9. A method of extracting chromium from nickel and cobalt-containing lateritic ore while extracting said nickel and cobalt which comprises, sizing said ore to provide a size fraction of fines below 20 microns in which substantial amounts of the chromium are acid-soluble in dilute sulfuric acid solution and also provide a coarse fraction falling within the range of over 20 microns and ranging up to about 3 mesh in which a substantial amount of chromium is insoluble in said dilute sulfuric acid, mixing with said coarse fraction an amount of an oxidizing agent selected from the group consisting of $Mn^{+4}$, $MnO_4^{-1}$ and $S_2O_8^{-2}$ at least stoichiometrically sufficient to oxidize chromium substantially to the hexavalent state, forming an aqueous slurry of said coarse fraction mixture with an acid solution containing 10 to 30 normal sulfuric acid and having an acid to ore ratio by weight of at least 3:1, subjecting said slurry to leaching at a temperature of about 150° C to 300° C at a pressure of about 70 psig to 1200 psig to leach said chromium therefrom, and form a pregnant solution containing said chromium and an insoluble residue, separating said pregnant solution from said insoluble residue, forming an aqueous pulp of said fines fraction, mixing with said fines fraction an amount of an oxidizing agent selected from the group consisting of $Mn^{+4}$, $MnO_4^{-1}$ and $S_2O_8^{-2}$ sufficient to oxidize chromium to substantially the hexavalent state, mixing said pregnant solution with said fines fraction pulp to dilute the acid content thereof to not more than 10 normal and provide an acid to ore ratio in said fines fraction of about 0.1 to 0.5 by weight, and then subjecting said pulp of fines fraction to pressure leaching at an elevated pressure and temperature to extract said soluble chromium from said fines fraction, thereby producing a final pregnant solution containing substantially said chromium extracted from both the fines fraction and said coarse fraction.

10. The method of claim 9, wherein the acid to ore ratio in the coarse fraction ranges from 5:1 to 25:1, and wherein the concentration of the sulfuric acid solution in the coarse fraction ranges from about 15 to 25 normal.

11. The method of claim 9, wherein the fines fraction is leached at a temperature of about 230° C to 280° C and a pressure of about 400 to 1000 psig.

12. The method of claim 9, wherein the oxidizing agent is $MnO_2$ added to the coarse fraction and to the fines fraction determined as a ratio to the amount of chromium present in each of the fraction ranges from about 1:1 to 4:1.

13. The method of claim 9, wherein the coarse fraction is leached at a temperature of about 150° C to 250° C.

* * * * *